US010710785B2

(12) United States Patent
Patwardhan

(10) Patent No.: US 10,710,785 B2
(45) Date of Patent: Jul. 14, 2020

(54) LOCKABLE PACKAGING AND A RELEASE MECHANISM THEREFOR

(71) Applicant: MeadWestvaco Corporation, Richmond, VA (US)

(72) Inventor: Tanuja A. Patwardhan, Richmond, VA (US)

(73) Assignee: WestRock MWV, LLC, Atlanta, GA (US)

( * ) Notice: Subject to any disclaimer, the term of this patent is extended or adjusted under 35 U.S.C. 154(b) by 935 days.

(21) Appl. No.: 14/690,554

(22) Filed: Apr. 20, 2015

(65) Prior Publication Data

US 2015/0307246 A1 Oct. 29, 2015

Related U.S. Application Data

(60) Provisional application No. 61/984,120, filed on Apr. 25, 2014.

(51) Int. Cl.

| | |
|---|---|
| ***B65D 55/02*** | (2006.01) |
| ***B65D 77/04*** | (2006.01) |
| ***B65D 83/04*** | (2006.01) |
| ***B65D 75/32*** | (2006.01) |
| ***B65D 5/38*** | (2006.01) |

(52) U.S. Cl.

CPC ..... *B65D 55/02* (2013.01); *B65D 5/38* (2013.01); *B65D 75/327* (2013.01); *B65D 77/0433* (2013.01); *B65D 83/0463* (2013.01); *B65D 2215/02* (2013.01)

(58) Field of Classification Search

CPC ..... B65D 55/02; B65D 5/38; B65D 75/327; B65D 77/0433

See application file for complete search history.

(56) References Cited

U.S. PATENT DOCUMENTS

| | | | | |
|---|---|---|---|---|
| 6,047,829 | A * | 4/2000 | Johnstone | B65D 5/38 206/1.5 |
| 6,874,636 | B2 * | 4/2005 | Paliotta | B65D 75/327 206/1.5 |
| 7,845,496 | B2 * | 12/2010 | Hession | B65D 5/38 206/528 |
| 9,573,720 | B2 * | 2/2017 | Dixon | B65D 5/38 |
| 2003/0047482 | A1 * | 3/2003 | Jones | B65D 5/38 206/534 |
| 2007/0054525 | A1 * | 3/2007 | Jones | B65D 5/38 439/159 |
| 2009/0152134 | A1 * | 6/2009 | Katsis | A24F 27/00 206/96 |

* cited by examiner

*Primary Examiner* — Steven A. Reynolds
*Assistant Examiner* — Javier A Pagan
(74) *Attorney, Agent, or Firm* — WestRock IP Legal

(57) ABSTRACT

A lockable child-resistant, senior-friendly package of the sleeve-and-drawer style may be utilised for in healthcare type applications for the unit dose dispensing of pharmaceutical tablets, capsules and lozenges; in consumer good packaging applications for items such as food, recreational drugs (e.g., tobaccos, cigars, cigarettes, etc.), toys, hardware, and electrical items, or the like; and in security package applications to deter package pilferage for small high-value items, such as consumer electronics. The sleeve-and-drawer style package has an internal slidable lockable receptacle, having a two-part locking mechanism and an improved release mechanism.

20 Claims, 7 Drawing Sheets

LOCKABLE PACKAGING AND A RELEASE MECHANISM THEREFOR

REFERENCE TO RELATED APPLICATION

This application claims the benefit of priority under 35 U.S.C. § 119(e) of U.S. provisional application Ser. No. 61/984,120 filed on Apr. 25, 2014 which is hereby incorporated by reference in its entirety.

FIELD OF THE INVENTION

The present invention relates generally to packaging, specifically but not exclusively, to lockable packaging such as child-resistant, senior-friendly packages. More specifically, but not exclusively, to packaging such as lockable sleeve-and-drawer style packages that may be utilised for example in: healthcare type applications for the unit dose dispensing of pharmaceutical tablets, capsules and lozenges; in consumer good packaging applications for items such as food, recreational drugs (e.g., tobaccos, cigars, cigarettes, etc.), toys, hardware, and electrical items, or the like; and in security package applications to deter package pilferage for small high-value items, such as consumer electronics. More specifically, but not exclusively, the invention relates to a sleeve-and-drawer style package having an internal slidable lockable receptacle, that is releasably lockable within an outer sleeve, the package having a two-part locking mechanism and an improved release mechanism therefor.

BACKGROUND OF THE INVENTION

In the field of packaging, particularly in the field of healthcare and medication packaging and in the field of sleeve-and-drawer style packaging for a wide range of consumer goods, it is often required to provide consumers or patients with secure packaging that has child-resistant features to restrict or prevent access to the package contents by a child. At the same time, it is useful for the intended user to be able to access the products contained within the package with some degree of ease. As such it is beneficial if the packaging is also "senior-friendly". Many packages are available that comprise an inner slide card or drawer that holds articles in blisters, compartments or in trays. The inner slide card, with the articles, is then slidable inside an outer sleeve. The inner slide card is usually retained and locked inside the outer sleeve by a locking flap that engages the outer sleeve. An unlocking mechanism (release mechanism) is also provided, usually on the outer sleeve, to permit the disengagement of the inner slide card from the outer sleeve. Such unlocking mechanisms often require some dexterity to operate or require user realisation that co-ordinated operation of more than one feature is required; this may make the package child-resistant. In some instances, this may also make the package less senior friendly than is desirable. It may be desirable to assist an authorised user of the package with accessing the package products.

Further considerations in this technical field are the need for such packages to be unlocked and relocked many times without failure. It is also desirable to keep the cost of the packaging as low as possible, whilst maintaining its durability. It is also advantageous to provide clearly printed information, for example, pill calendars, product data such as the name or type of medication and/or other patient directed information on the package.

A further consideration is that the size of the package is preferably minimised, not only to reduce its production costs by using less material, but also to reduce shipping costs. A light-weight and compact package, with a locking and unlocking feature that can withstand repeated use is therefore advantageous.

The present invention seeks to provide an improvement in the field of packaging, more specifically, but not exclusively, in the field of sleeve-and-drawer style packages by providing an improved release mechanism therefor.

SUMMARY OF THE INVENTION

According to an aspect of the invention for which protection is sought, there is provided a package including a two-part locking mechanism and a release mechanism for deactivating the two-part locking mechanism, the release mechanism including a depressible zone, the depressible zone being formed in a panel of the package and being defined by two oppositely positioned and spaced cut or frangible side edges and the depressible zone otherwise being continuously formed with said panel, the depressible zone being structured and arranged such that the depressible zone is deformable below the plane of the said panel to cause the two-part locking mechanism to be unlocked.

Optionally, said two oppositely positioned cut or frangible side edges are each straight such that the depressible zone is generally rectangular in shape.

Optionally, said two oppositely positioned cut or frangible side edges are each curved such that the depressible zone is generally concave in shape.

Optionally, said two oppositely positioned cut or frangible side edges are each curved such that the depressible zone is generally convex in shape.

Optionally, each of said two oppositely positioned cut or frangible side edges includes a tear stop at each of its ends.

Optionally, each tear stop is a "J"-shaped termination.

Optionally, the depressible zone is structured and arranged such that the depressible zone is deformable below the plane of the said panel by the provision of one or more intermediate fold lines extending between and terminating on each of the two oppositely positioned cut or frangible side edges.

Optionally, the depressible zone is further defined by two outer fold lines, each outer fold line extending between and terminating on the side cuts of the depressible zone.

Optionally, the one or more intermediate fold lines includes two intermediate fold lines both formed closer to one of said outer fold lines than to the other of said outer fold lines.

Optionally, the package includes an outer sleeve and a lockable receptacle, the outer sleeve providing a cavity for the lockable receptacle, the two-part locking mechanism for locking the lockable receptacle within the cavity of the outer sleeve and wherein the release mechanism is operable such that the lockable receptacle can be at least partially withdrawn from the outer sleeve.

Optionally, the depressible tab is symmetrical in shape about a notional central axis of the depressible tab.

Optionally, the notional central axis extends between said two outer fold lines.

Optionally, the notional central axis is parallel to a longitudinal axis of the outer sleeve or the notional central axis is perpendicular to a longitudinal axis of the outer sleeve.

Optionally, the notional central axis is disposed at a non-normal angle relative to a longitudinal axis or lateral axis of the outer sleeve. The non-normal angle may be between about 35° and about 55°. The non-normal angle may be about 45°.

Optionally, the outer sleeve includes a closed rear end and an open or openable front end through which the lockable receptacle is insertable and through which the lockable receptacle is withdrawable.

Optionally, the panel is an outer top panel of the outer sleeve and wherein the outer sleeve additionally includes a bottom panel spaced from said outer top panel by first and second adjoining side panels and wherein an inner top panel is provided, the inner top panel being affixed in face contacting relationship to the outer top panel and including the first part of the two-part locking mechanism and including a moveable tab which forms part of the release mechanism.

Optionally, the first part of the two-part locking mechanism includes a locking edge defined by an aperture in the inner top panel disposed beneath said outer top panel; wherein the lockable receptacle includes a folded locking foot, a free edge of which is receivable within the aperture and catchable against said locking edge for locking the lockable receptacle within the outer sleeve and wherein the depressible zone and movable tab are positioned and arranged such that depression of the depressible zone causes the depressible zone to bow beneath the plane of the outer top panel and which causes the moveable tab to move and cause the folded locking tail foot to be disengaged from the locking edge.

Optionally, said moveable tab includes: an anchored portion attached to the inner top panel of the outer sleeve; a front edge defined by the aperture; a first side edge and a second side edge; wherein the first and second side edges of the moveable tab are cut or frangible edges; wherein the first and second side edges are parallel to one another; and wherein the moveable tab is substantially "U"-shaped.

Optionally, an outer top panel of the outer sleeve includes a demarcated pressing zone disposed in registry with the depressible zone to assist a user in correctly directing an applied force toward said moveable tab such that sufficient depression of the moveable tab occurs to cause the two-part locking mechanism to be unlocked.

According to another aspect of the invention for which protection is sought, there is provided an outer sleeve for use in the package according to any of the relevant preceding paragraphs.

According to yet another aspect of the invention for which protection is sought, there is provided a blank of foldable material structured and arranged for being assembled into an outer sleeve, the blank including a series of panels for forming walls of the outer sleeve including a first top panel in which the depressible zone defined by two oppositely positioned and spaced cut or frangible side edges is integrally formed.

Within the scope of this application it is envisaged and intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Embodiments of the invention will now be described by way of example only, with reference to the following drawings.

DETAILED DESCRIPTION OF THE PREFERRED EMBODIMENTS

Figures 1, 1A:
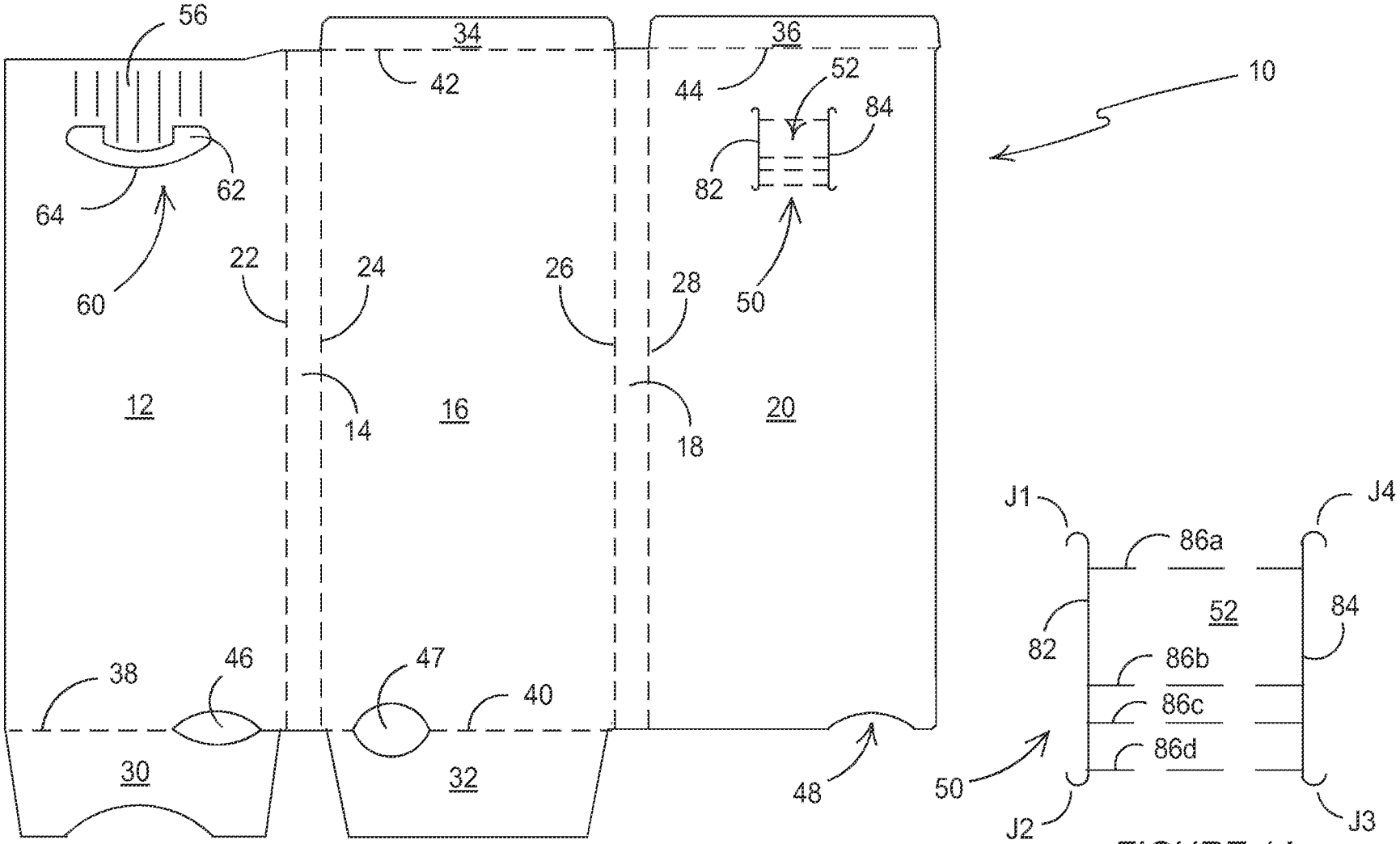
FIG. 1 is a plan view of a blank for forming an outer sleeve having a release mechanism according to a first embodiment of the disclosure, the outer sleeve formed from the blank is used in forming a sleeve-and-drawer style lockable package (shown in FIG. 2B below)
FIG. 1A is an enlarged plan view of part of the blank of FIG. 1 showing part of a release mechanism according to a first embodiment of the disclosure.

Detailed descriptions of specific embodiments of the outer sleeves, lockable receptacles, packages and blanks are disclosed herein. It will be understood that the disclosed embodiments are merely examples of the way in which certain aspects of the invention can be implemented and do not represent an exhaustive list of all of the ways the invention may be embodied. Indeed, it will be understood that the outer sleeves, lockable receptacles, packages and blanks described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention. The Figures and detailed description are provided to describe and illustrate examples in which the disclosed package and its parts may be made and used, and are not intended to limit the scope thereof. Those skilled in the art will readily appreciate that the disclosed packages can be used to store a variety of products. More specifically, the disclosed lockable receptacles can be used for the storage of products, such as for example, medication and other medical or pharmaceutical products, smokeless tobacco, cigarettes, confectionary, tea bags, mints, food items, electrical items, homecare products (such as detergents in pods) or any product stored in a pouch, blister or compartment, and the like without departing from the inventive aspects of the present disclosure.

Generally the present invention teaches the provision of a new release mechanism for use with a variety of packages wherein a locking mechanism is released, out of its locked position by means of the release mechanism. The release mechanism includes a depressible zone that is different to typical "U"-shaped moveble release tabs that are known in the art. The typical "U"-shaped moveable release tabs have an anchored portion and a moveable portion that is often defined by a substantially "U"-shaped cut line or frangible line. The moveable portion can hinge about the anchored portion below the plane of a panel in which it is formed for disengaging a locking mechanism. In contrast, the release mechanisms disclosed herein include a depressible zone that is defined by a pair of similar, oppositely positioned and spaced side edges and that is anchored at each of its ends. The depressible zone is structured and arranged such that it can be depressed sufficiently to cause disengagement of a mechanical locking mechanism.

Packages including the release mechanisms of the present invention may be utilized in applications where child-resistance is required (for example in pharmaceutical and healthcare packaging); however the application of the release mechanism is not so limited and its application in other forms of packaging, such as secure packaging for high-value products and repeated use dispensing packaging for consumer items is envisaged. The release mechanism of the disclosure may be utilized with a variety of styles of lockable package and is not limited to the sleeve-and-drawer style shown herein. The release mechanism of the disclosure may be utilized with a variety of lockable packages made from a variety of materials, including for example, plastics material, paperboard and combinations thereof.

The release mechanism of the disclosure includes a depressible zone that is typically formed from a panel of material forming a main part of the package. The depressible zone is configured and oriented such that a portion of the depressible zone consistently and repeatedly bows beneath that panel to a sufficient extent such that the depressible zone directly, or indirectly can disengage a lockable receptacle out of locking engagement with a locking mechanism.

The depressible zone may be variously arranged relative to the package and it will be understood upon reading the following descriptions of specific embodiments that the pair of similar, oppositely positioned and spaced side edges can be arranged: parallel to, orthogonal to and/or at a non-normal angle, relative to one or more primary axes of the package.

Release mechanisms of the disclosure including such depressible zones offer a number of benefits that, in dependence upon the application of the package, may include:

(i) improving a user's opening experience;
(ii) increasing child resistance since inadvertent opening may be mitigated against;
(iii) providing a more intuitive feel for senior user's; and
(iv) assisting in authorized entry by authorized (senior) users and further prohibiting unauthorized entry by children.

Figure 2B:
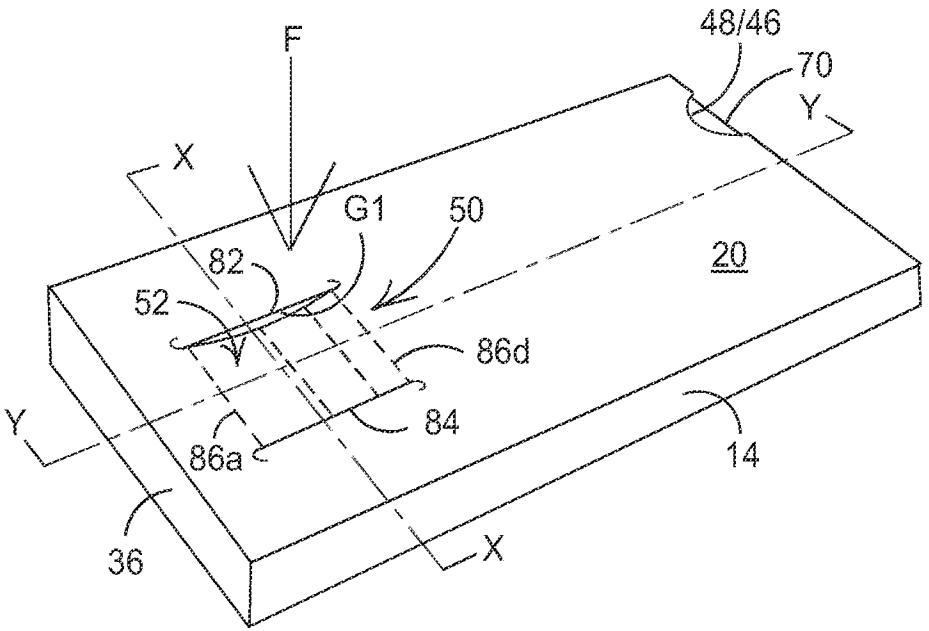
FIG. 2B is a perspective view of a package including the outer sleeve of FIG. 2A; a lockable receptacle (shown in FIG. 2C); a two-part locking mechanism; and the release mechanism according to a first embodiment of the disclosure, wherein the release mechanism is shown in a deployed position.
Figure 2A:
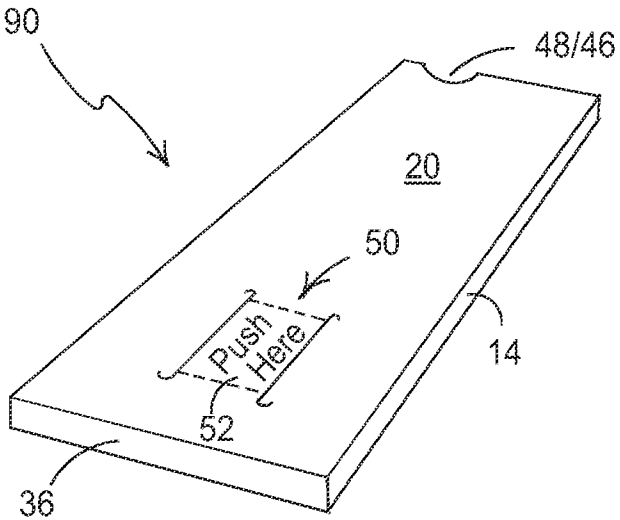
FIG. 2A is a perspective view of an outer sleeve formed from the blank of FIG. 1; a lockable receptacle (shown in FIG. 2C); a two-part locking mechanism; and the release mechanism according to a first embodiment of the disclosure.
Figure 2C:
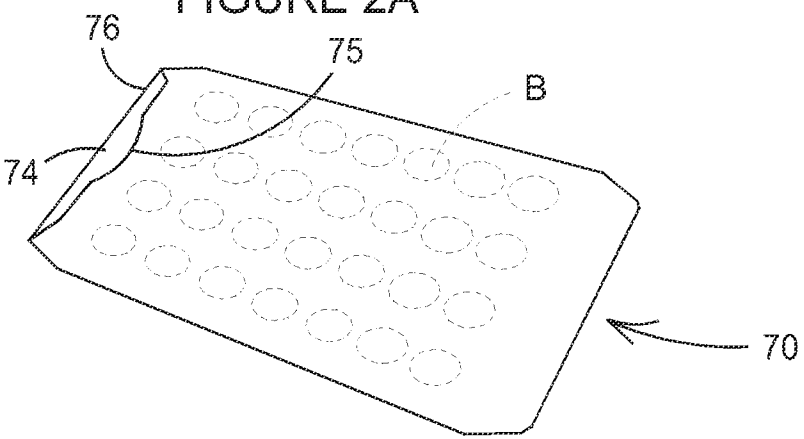
FIG. 2C is a perspective view of an example of a lockable receptacle that is secured in the package of FIG. 2B, the lockable receptacle is configured to hold items in blisters that are secured therein by a sealing film, and the lockable receptacle has a locking foot for engagement with the outer sleeve of the package.
Figure 3A:
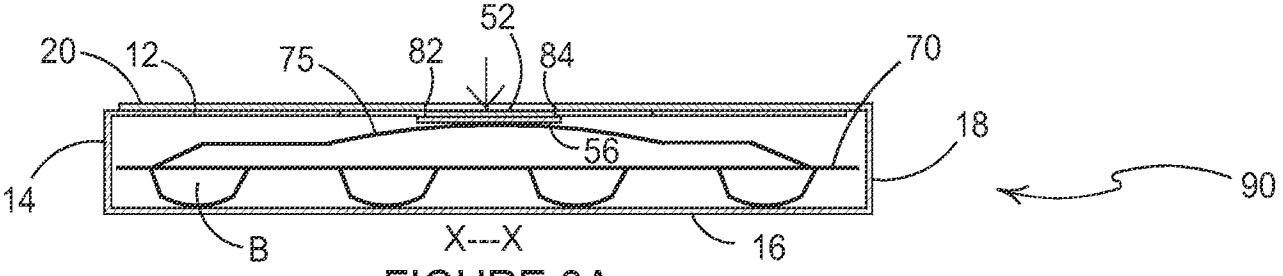
FIG. 3A is a cross-sectional view taken along the line XX shown in FIG. 2B, laterally across the deployed release mechanism, illustrating how the release mechanism interacts with the lockable receptacle of FIG. 2C to release the lockable receptacle from its locking engagement with the outer sleeve.
Figure 3B:
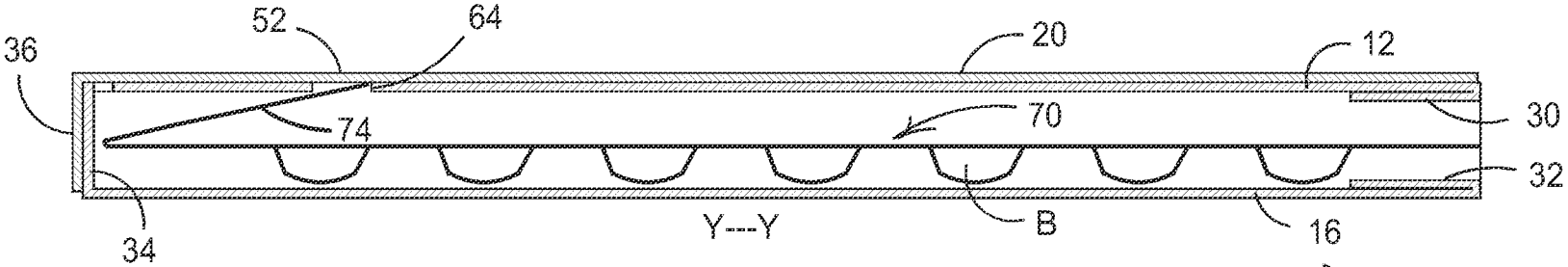
FIG. 3B is an enlarged part of a cross-sectional view taken along the line YY shown in FIG. 2B albeit showing the release mechanism in an inactive state and showing how the lockable receptacle engages with a first-part of a two part complementary locking mechanism of the package to lock the lockable receptacle within the outer sleeve.

Specific embodiments of release mechanisms 50, 150, 250 including depressible zones 52, 152, 252 according to aspects of the invention are illustrated herein in relation to sleeve-and-drawer style packages (optionally formed primarily of paperboard). In such sleeve-and-drawer style packages a lockable receptacle 70 (optionally formed from plastics and foil material) is retained within the package, the lockable receptacle optionally includes a plurality of blisters 'B', each for retaining a unit dose of medication. It is to be understood however, that the release mechanisms 50, 150, 250 and depressible zones 52, 152, 252 of the disclosure are not limited to this particular application. Indeed it is envisaged that the release mechanism may be utilized in conjunction with a closing mechanism for a wide variety of carton styles and is not limited to the release of a lockable receptacle from within a sleeve-and-drawer style package. Referring now to FIGS. 1 through to 3C, there is illustrated a first embodiment of the disclosure. In FIGS. 2A and 2B perspective views of a top 20, end 36 and first side 14 of an outer sleeve 90 and package respectively are shown. The package is a sleeve-and-drawer style package and the outer sleeve 90 is formed from a blank 10 (see FIG. 1). The package includes a lockable receptacle 70 that is shown in perspective view from a rear-side in FIG. 2C. Part of the lockable receptacle 70 is shown in cross-section in FIGS. 3A, 3B and 3C. The lockable receptacle 70 is of the form of a blister strip with an integrally formed locking tail flap 74 (also referred to herein as locking foot 74) hinged thereto via a hinge connection 76. The outer sleeve 90 includes a first part of a two-part complementary locking mechanism. In this embodiment, the first part of the two-part complementary locking mechanism includes an aperture 62 and a single-ply locking edge 64 (see FIGS. 1, 3B and 3C). The lockable receptacle 70 includes a second part of the two-part complementary locking mechanism provided by the folded locking foot 74 having a leading engaging edge 75. The package includes a release mechanism 50 which is, in this arrangement, entirely formed in the outer sleeve 90. The release mechanism 50 includes an outer depressible zone 52 (see FIGS. 1, 2A, 2B, 3A, 3B and 3C) with an associated, optional inner moveable tab 56 (see FIGS. 1, 2A, 2B, 3A, 3B and 3C). The lockable receptacle 70 is slidably insertable through an open end of the outer sleeve 90 and is securably locked therein by operation of the two-part complementary locking mechanism. The locking operation of the two-part locking mechanism is illustrated in FIG. 3B.

Referring in more detail to the structure of the outer sleeve 90, in FIG. 1 a blank 10 for forming the outer sleeve 90 is illustrated. The blank 10 is formed of a suitable foldable substrate, for example paperboard, optionally having at least one coated and printed side. In other embodiments, the blank 10 may be formed from any one or a combination of: paper, paperboard, fibreboard, plastics material, coated material, uncoated material and printed material. Optionally in the present embodiment, the blank 10 is a sheet of paperboard having a polymer based tear resistant coating on one side thereof, for example the blank 10 may be formed from Printkote® EasySeal Plus paperboard.

The blank 10 includes, in series: an inner top panel 12, a first side panel 14, a bottom panel 16, a second side panel 18, and an outer top panel 20, hinged one to the next by means of longitudinally extending fold lines 22, 24, 26 and 28 respectively.

The blank 10 includes elements for forming the first part 60 of a two-part locking mechanism 74/60. The elements include: an aperture 62 and a first edge 64 formed in the inner top panel 12 (the first edge 64 being defined by the aperture 62). The aperture 62 may be considered as a recess into which, in use in the locked configuration, the locking foot 74 of the lockable receptacle 70 may be at least partially inserted as the leading free edge 75 of the locking foot 74 abuts, engages or otherwise connects with the locking edge 64.

The blank 10 further includes elements for forming the release mechanism denoted generally by reference 50. The elements for forming the release mechanism 50 optionally include: an outer depressible zone 52 formed in the outer top panel 20; and an optional inner moveable tab 56 formed in the inner top panel 12. The depressible zone 52 and moveable tab 56 are preferably, but nevertheless optionally, integrally formed within the blank 10. In other words, they are formed from material forming part of the primary panels of the outer sleeve 90 and no additional material is required to form the release mechanism 50 than would otherwise be used in forming a sleeve of sufficient dimension to enclose the lockable receptacle 70.

The depressible zone 52 is shown in an enlarged view in FIG. 1A, wherein it can be seen that the depressible zone 52 is defined by two spaced side edges 82, 84. Each side edge 82, 84 is optionally formed from a cut line. The side edges 82, 84 are substantially parallel, substantially straight (linear), optionally symmetrically arranged and optionally longitudinally extending (in other words are parallel to a longitudinal axis of the top panel 20). Each end of each side edge 82, 84 preferably terminates in a tear stop J1, J2, J3, J4 to prevent propagation of a tear that might otherwise emanate from the ends of the side edges 82, 84. In the present embodiment, each tear stop J1, J2, J3, J4 takes the form of a sharply radiussed arcuate or "J"-shaped cut that returns on itself to a sufficient degree to prevent the propagation of a tear emanating from the terminal end of each side edge 82, 84.

A series of fold lines 86*a*, 86*b*, 86*c*, 86*d* extend between the side edges 82, 84. Optionally, in the first embodiment, the series of fold lines includes four fold lines 86*a*, 86*b*, 86*c*, 86*d*. The fold lines 86*a*, 86*b*, 86*c*, 86*d* are provided to pre-define and control the manner in which the depressible zone 52 is folded, bends and bows, when a force 'F' is applied to it (see FIG. 2B). Preferably two outer fold lines 86*a*, 86*d* are provided between the side edges 82, 84 and proximate to the tear stops J1/J4, J2/J3 respectively. The two outer fold lines 86*a*, 86*d* may be considered to define notional limits of the depressible zone 52. In other words on the depressible zone 52 side of each outer fold line 86*a*, 86*d*, material of the top panel 20 forms part of the depressible zone and can be moved below the plane of the rest of the top panel 20; whereas on the other side of each outer fold line 86*a*, 86*d*, material of the top panel 20 does not form part of the depressible zone 52 and does not substantially bow or bend upon deployment of the release mechanism 50 (again see FIG. 2B).

In between the two outer fold lines 86*a*, 86*d*, one or more intermediate fold lines, in this example two intermediate fold lines 86*b*, 86*c* are provided. The relative positioning of these intermediate fold lines 86*b*, 86*c* with respect to each other and with respect to the two outer fold lines 86*a*, 86*d*, may determine the manner in which the depressible zone 52 bows, bends and deforms as it is deployed. The shape of the depressed depressible zone 52 is deliberately created such that the lowest part of the depressed depressible zone 52 contacts and locates on the locking foot 74 of the lockable receptacle 70 at an optimum location to sufficiently dislodge the locking foot 74 to disengage it from the first-part 60 of the two-part complementary locking mechanism 60/74. (In the present embodiment, the depressed depressible zone 52 contacts and locates on the locking foot 74 of the lockable receptacle 70 indirectly via the inner moveable tab 56, however, in other embodiments, the depressed depressible zone 52 contacts and locates on the locking foot 74 directly).

In the present embodiment the two intermediate fold lines 86*b*, 86*c* are optionally both formed closer to the front most outer fold line 86*d* than they are to the rear most outer fold line 86*a*. Each of the outer fold lines 86*a*, 86*d* and intermediate fold lines 86*b*, 86*c* are straight (linear), are each optionally laterally extending (relative to the outer top panel 20) and are each optionally substantially perpendicular relative to the side edges 82, 84 of the depressible zone 52. Each of the outer fold lines 86*a*, 86*d* and intermediate fold lines 86*b*, 86*c* terminate on or at the side edges 82, 84 and as such fully extend across the depressible zone 52.

The optional inner moveable tab 56, includes an anchored portion and a free edge which is defined by the aperture 62 such that the free edge is separated from the remainder of the inner top panel 12. The moveable tab 56 is thereby pivotally moveable below the inner top panel 12 such that it can be moved by the depressible zone 52. Optionally, the depressible zone 52 formed in the outer top panel 20 is slightly greater in maximum width than the maximum width of the innermost moveable tab 56 in the inner top panel 12 (this is best viewed in FIG. 3A).

The depressible zone 52 is optionally disposed in a substantially medial position within the outer top panel 20. The substantially medial position of the generally rectangular-shaped depressible zone 52 may be defined by consideration of a central axis of the depressible zone 52 which may be in line with a medial longitudinal axis of the outer top panel 20. About the central axis, the depressible zone 52, its side edges 82, 84, outer fold lines 86*a*, 86*d* and intermediate fold lines 86*b*, 86*c* are symmetrical.

Figure 5A:
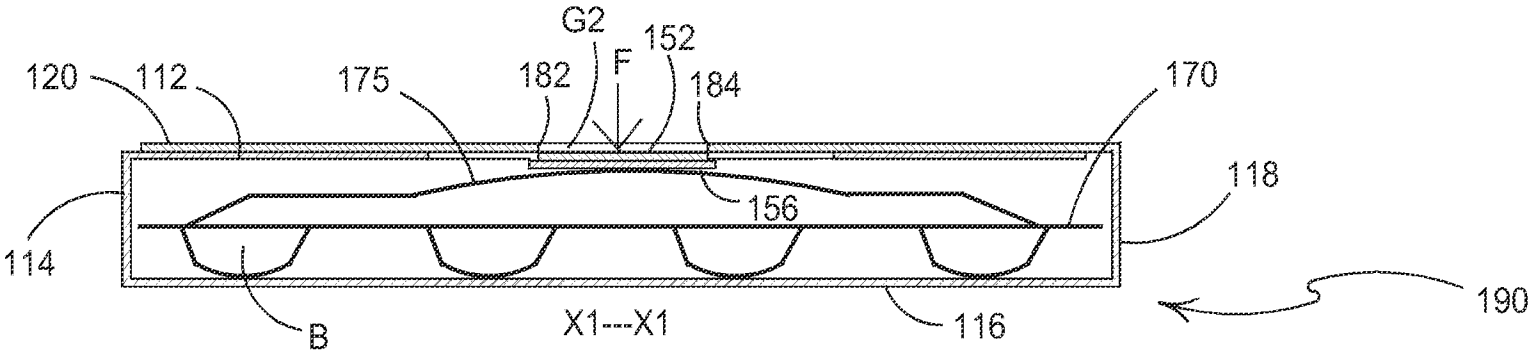
FIG. 5A is a cross-sectional view taken along the line X1-X1 shown in FIG. 4B, laterally across the deployed release mechanism of the second embodiment, illustrating how the release mechanism interacts with the lockable receptacle of FIG. 2C to release the lockable receptacle from its locking engagement with the outer sleeve of FIG. 4B.
Figure 5B:
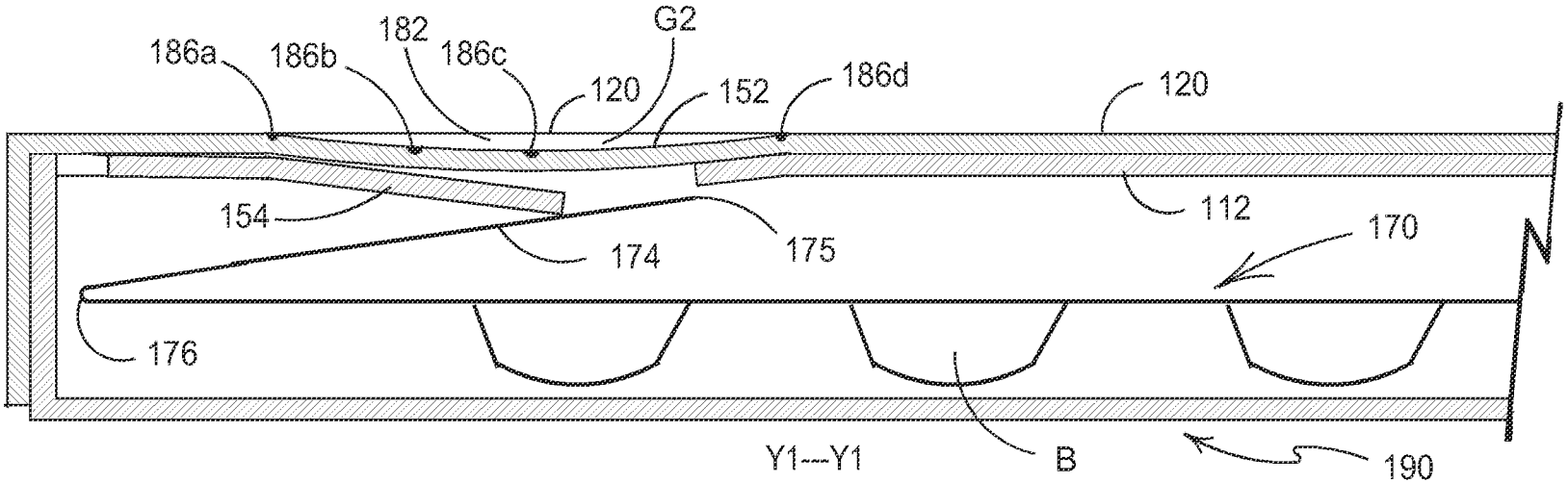
FIG. 5B is an enlarged view of part of a cross-sectional view taken along the line Y1-Y1 shown in FIG. 4B, longitudinally through the deployed release mechanism of the second embodiment, illustrating how the release mechanism interacts with the lockable receptacle of FIG. 2C to release the lockable receptacle from its locking engagement with the outer sleeve of FIG. 4B.

The blank 10 additionally includes rear end flaps 34, 36 that are hinged by fold lines 42, 44 to the "rear" ends of the bottom panel 16 and outer top panel 20. These rear end flaps 34, 36, in use, are folded approximately 90° about fold lines 42 and 44 and are affixed in face contacting relationship to one another to form a composite end wall 34/36 for the outer sleeve 90 (see FIGS. 5, 5A and 6). The composite end wall 34/36 may be referred to herein as a "rear end wall".

Finally, the blank 10 includes a first front end flap 30 and an optional second front end flap 32 hinged by fold lines 38 and 40 to the "open" ends of the inner top panel 12 and bottom panel 16 respectively. Fold line 38 is optionally interrupted by an aperture 46 which provides a recess by which a user can grasp a portion of a lockable receptacle 70 (see FIG. 2C) to assist in sliding it from the closed position into an open or partially open position. Similarly, fold line 40 is interrupted by an aperture 47 which also forms a recess to assist a user grasping the lockable receptacle 70 once the blank 10 has been constructed into the outer sleeve 90 and the lockable receptacle 70 stowed therein. The first and second end flaps 30, 32, in use, are folded approximately 180° about fold lines 38 and 40. The first front end flap 30 is not necessarily affixed to the inside surface of the inner top panel 12, but in the present arrangement, is affixed to the inside surface of the inner top panel 12. Similarly, the second front end flap 32 preferably is affixed in face contacting relationship to the bottom panel 16. Once folded and formed in this way, the first and second end flaps 30, 32 each optionally serve to provide a smooth finish to the "open" end of the outer sleeve 90, and the first end flap 30 may serve as part of an optional stopping mechanism provided for preventing or at least mitigating against the complete withdrawal and separation of the lockable receptacle 70 from the outer sleeve 90.

Turning in more detail to the construction of the outer sleeve 90 from the blank 10, the blank 10 may be oriented so that its uncoated, unprinted side faces out. Optionally, the first and second end flaps 30, 32 are folded about fold lines 38, 40 and optionally the first and second front end flaps 30, 32 are affixed to the inside face (non-printed face) of the inner top panel 12 and bottom panel 16 respectively. Adhesive (such as hot melt glue) may be applied to one or both of the first and second end flaps 30, 32 and the inner top panel 12 and bottom panel 16. Then, the inner top panel 12 together with the first side panel 14 may be folded about fold line 24 to bring the inner top panel 12 and first side panel 14 into face contacting relationship with the inside faces of the bottom panel 16 and second side panel 18 respectively. Optionally, adhesive may be applied to parts of the inner top panel 12 and/or to parts of the outer top panel 20. The outer top panel 20 is then folded about fold line 28 to bring it into face-contacting relationship with the inner top panel 12 such that the outer top panel 20 and the inner top panel 12 are affixed together.

At this point, construction of the outer sleeve 90 is not entirely completed since the rear end wall 34/36 has not been assembled. In this state, however, the outer sleeve 90 is in a flat form (not shown). It has been folded and part assembled and it is in this flat form that the outer sleeve 90 would preferably be shipped to a converting plant. As such, construction of the outer sleeve 90 may be fully completed at a converting plant, where the outer sleeve 90 is opened into a tubular form, optionally loaded from one or both of the open (front) or rear ends with a product-holding lockable receptacle 70. The rear end wall 34/36 is optionally then constructed by folding the rear end panels 34, 36 about fold lines 42, 44 and into affixed and face contacting relationship. Preferably, the bottom rear end flap 34 is folded up first and the top rear end flap 36 is then folded downwardly and is affixed thereto.

In this embodiment, the lockable receptacle 70 is optionally loaded through the open front end, after the rear end wall 34/36 has been constructed. To install the lockable receptacle 70 into the outer sleeve 90, the locking foot 74 is folded toward (the non-blister side) the main body and optionally, in this form, the lockable receptacle 70 is slidably pushed into the outer sleeve 90, leading with the hinge connection 76, through the open front end and towards the closed rear end wall 34/36.

The package so formed, in a closed configuration is shown in FIG. 2B. The lockable receptacle 70 is automatically locked in the closed configuration within the outer sleeve 90 by operation of the two-part complementary locking mechanism 74/60. This is best illustrated in FIG. 3B, wherein it can be seen that, due to the natural resilience of the material from which the locking foot 74 and/or lockable receptacle 70 is at least in part formed, the folded locking foot 74 unfolds slightly, into the gap or recess provided by the aperture 62. In this way, the locking foot 74 catches on the locking edge 64 provided by the internal face of the cut locking edge 64.

Once the outer sleeve 90 is assembled, the release mechanism 50 is also formed. As can also be seen in FIG. 5A, the depressible zone 52 is disposed in at least partial super position above the moveable tab 56 and is disposed in at least partial registry with the aperture 62 such that the depressible zone 52 can be depressed and bowed into the aperture 62. In conjunction with moveable tab 56, the depressible zone 52 can thereby be used to dislodge the locking foot 74 out of engagement with the recess 62 and locking edge 64.

Referring to FIG. 2B, it can be seen that when a downward force 'F' is applied in the vicinity of the intermediate fold lines 86*b*, 86*c*, the depressible zone 52 bows below the plane of the outer top panel 20. This is illustrated by the opening of gap G1 (see FIG. 2B) and by the movement of part of the depressible zone 52 completely below the plane of the remaining part of the outer top panel 20 (see FIGS. 3A and 3B). The lowest bent part of the depressible zone 52 is sufficiently bowed below the plane of the outer top panel 20 that it contacts the inner moveable tab 56 which in turn displaces the locking foot 74 of the lockable receptacle 70 to facilitate its release. To ensure that the depressible zone 52 bends and bows in the correct manner and in the correct place, the applied release force 'F', must be properly located. If the release force F is located too far away from the vicinity of the intermediate fold lines 86*b*, 86*b*, then the depressible zone 52 will not necessarily be bent and bowed in a suitable manner and will not release the lockable receptacle 70. Creating a release mechanism 50 that requires an authorized user to more carefully locate the release force 'F' that they apply may mitigate against inadvertent access being gained and thereby may make the package more child proof. The form and size of the side cuts 82, 84 and shape of the depressible zone 52 may naturally encourage an authorized user to appropriately locate the required force such that the release mechanism is also senior-friendly.

Simultaneously, the lockable receptacle 70 can be withdrawn from the outer sleeve 90. The thumb recess 46/48 may assist a user in grasping the lockable receptacle 70, when it is disposed fully within the outer sleeve 90, in order to withdraw it from the outer sleeve 90. In dependence upon the extent to which the lockable receptacle 70 is withdrawn from the outer sleeve 90, access to one or more or all of the product-holding blisters 'B' can be gained. As such it will be realized that a user is required to hold the package in one hand and with that same hand, depress the depressible zone 52, whilst at the same time, gripping and pulling an end edge of the lockable receptacle 70 with their other hand. This requires a degree of dexterity and provides a child-resistant locking mechanism. In the fully withdrawn position, the stopping mechanism 30/74 optionally acts to prevent the lockable receptacle 70 from becoming fully separated or detached from the outer sleeve 90. The locking foot 74 catches on an edge provided by the first end flap 30.

Figure 3C:
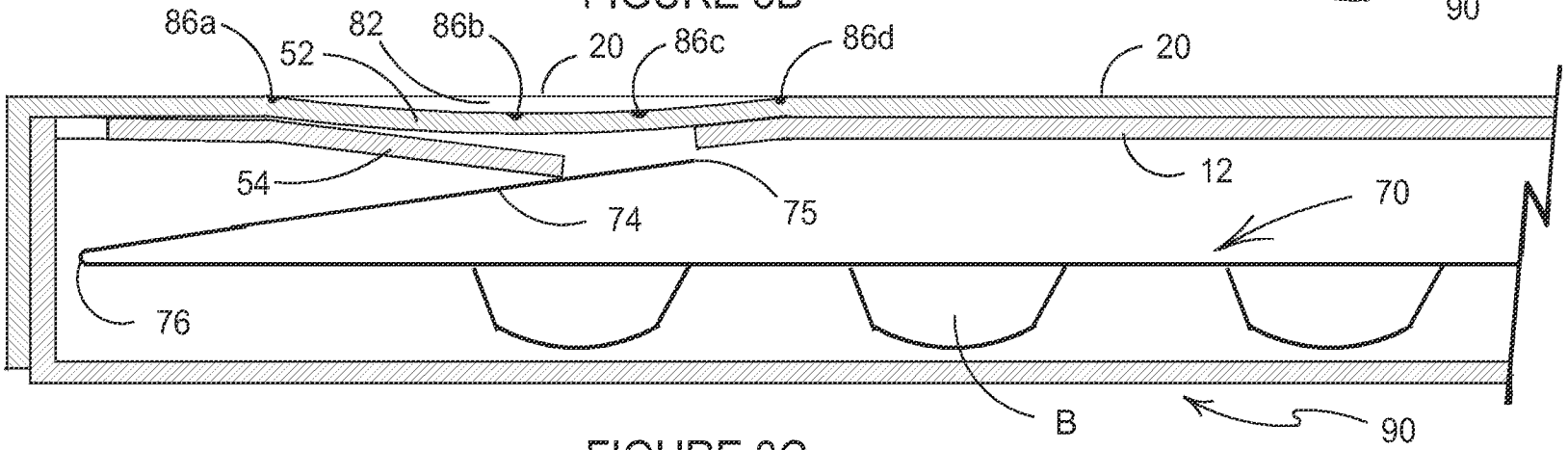
FIG. 3C is an enlarged part of a cross-sectional view taken along the line YY shown in FIG. 2B longitudinally through the deployed release mechanism, illustrating how the release mechanism interacts with the lockable receptacle of FIG. 2C to release the lockable receptacle from its locking engagement with the outer sleeve.

Unlocking of the lockable receptacle 70 is shown in a cross-sectional view in FIG. 3C, wherein it can be seen that the bowed depressible zone 52 presses the moveable tab 54 to dislodge the locking foot 74.

Beneficially, the rectangular depressible zone that remains integrally connected, contiguous and anchored at each of its ends to the outer top panel 20 provides a more resilient and resistant release button compared to known "U"-shaped moveable release tabs. As such, the depressible zone 52 may be less susceptible to damage and failure and additionally may be more child resistant. The substantially contiguous nature of the depressible zone 52 that only has side cuts 82, 84 interrupting the surface of the outer top panel 20 may additionally, beneficially provide additional printable surface.

Referring now to FIGS. 4A to 5B; and to FIGS. 6A to 7B, a second embodiment and a third embodiment of the present disclosure are illustrated. In the second and third illustrated embodiments, like numerals have been used to denote like parts, albeit with the addition of the prefix "100" and "200" respectively, to indicate that these features belong to the second and third embodiments. The second and third embodiments share many common features with the first embodiment and therefore only the differences from the embodiment illustrated in FIGS. 1 to 3C will be described in any greater detail.

Figure 4A:
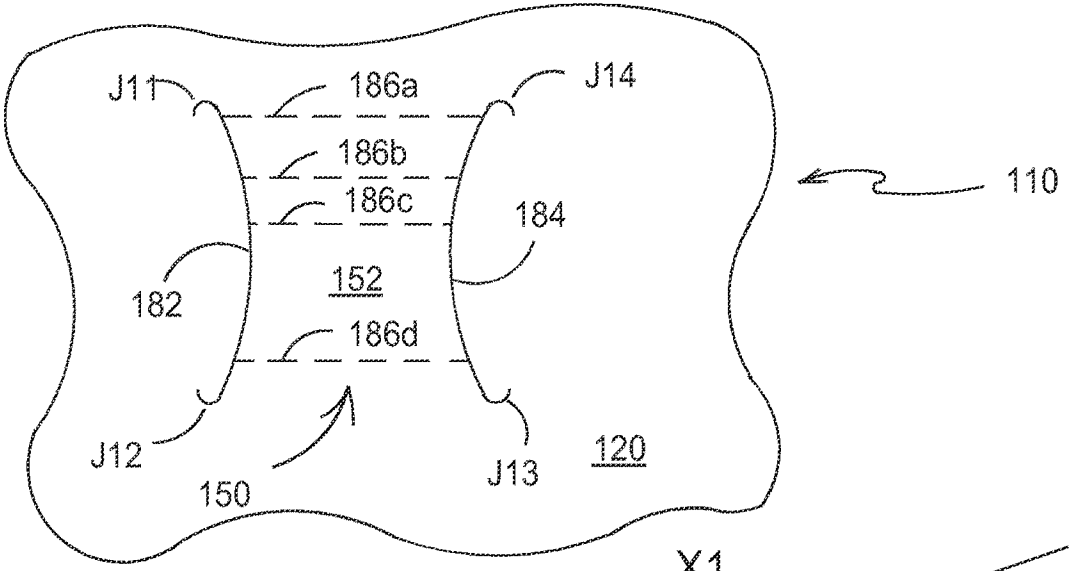
FIG. 4A is an enlarged plan view of part of a blank, similar to that of FIG. 1 for forming an outer sleeve, but having a release mechanism according to a second embodiment of the disclosure.
Figure 4B:
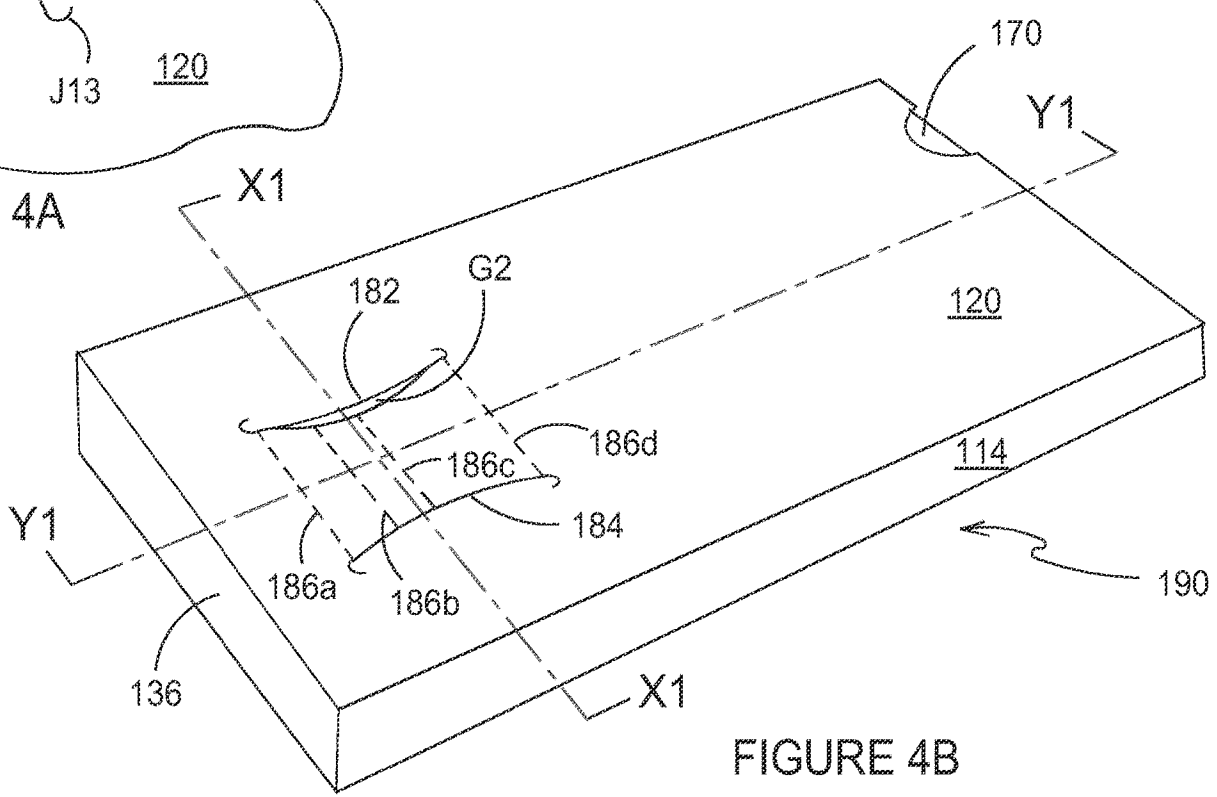
FIG. 4B is a perspective view of a package including an outer sleeve formed from a blank, part of which is shown in FIG. 4A; the lockable receptacle shown in FIG. 2C; a two-part locking mechanism; and a release mechanism according to the second embodiment of the disclosure.

In FIG. 4A an enlarged view of part of a blank 110 for forming an outer sleeve 190 is shown, to illustrate the depressible zone 152 of the second embodiment. The depressible zone 152 differs from the depressible zone 52 of the first embodiment, in that the side cuts 182, 184 are inwardly curved and the depressible zone is concave shaped and in part narrower. The side cuts 182, 184 are spaced and are symmetrical about a central notional axis that is parallel with a longitudinal axis of the outer top panel 120 of the outer sleeve 190 (see FIG. 4B). The overall concave shape may encourage an authorized user to locate the release force they apply in the narrow region, which may provide a "sweet-spot" for effective release of the lockable receptacle 70. Again two intermediate fold lines 186*b*, 186*c* are provided, but they are each a different length since they terminate on different parts of the concavely curved side edges 182, 184.

As with the first embodiment, when a downward force is applied in the vicinity of the intermediate fold lines 186*b*, 186*c*, the depressible zone 152 bows below the plane of the remainder of the outer top panel 120. This is illustrated by the opening of the gap G2 shown in FIG. 4B. The depressible zone 152 is depressed such that its lowest bent part is sufficiently bowed below the plane of the outer top panel 120 to contact the inner moveable tab 156 which in turn displaces the locking foot 174 of the lockable receptacle 170 to facilitate its release. As before, to ensure that the depressible zone 152 bends and bows in the correct manner and in the correct place, the applied release force is preferably properly located in the vicinity of the intermediate fold lines 186*b*, 186*c*. Creating a release mechanism 150 that may require an authorized user to carefully locate the release they apply, may mitigate against inadvertent access being gained and thereby make the package more child proof.

Figure 6A:
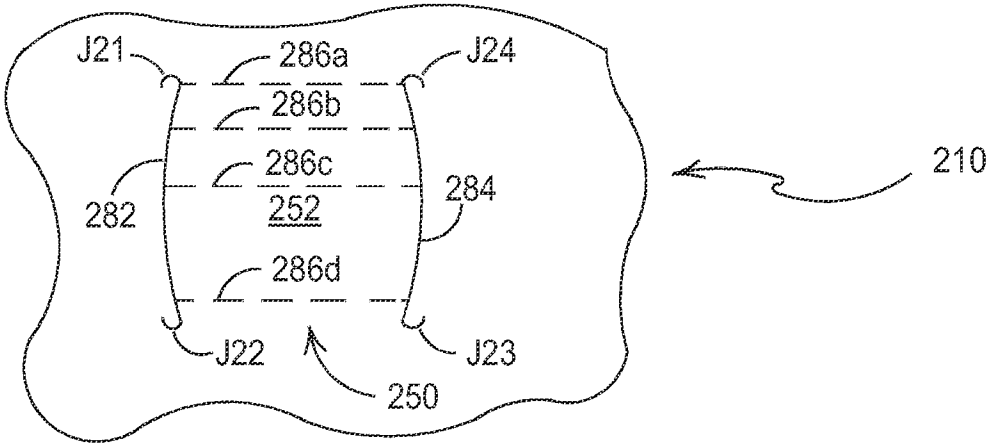
FIG. 6A is an enlarged plan view of part of a blank, similar to that of FIG. 1 for forming an outer sleeve, but having a release mechanism according to a third embodiment of the disclosure.
Figure 6B:
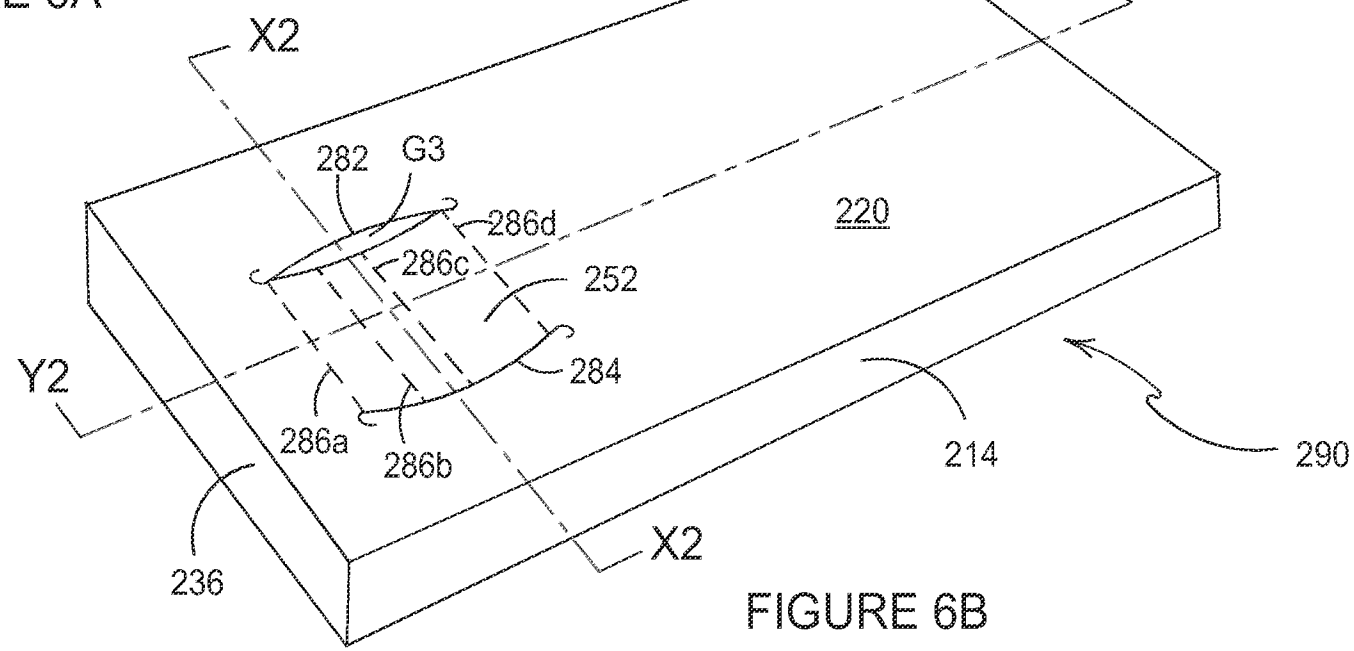
FIG. 6B is a perspective view of a package including an outer sleeve formed from a blank, part of which is shown in FIG. 6A; the lockable receptacle shown in FIG. 2C; a two-part locking mechanism; and a release mechanism according to the third embodiment of the disclosure.

In FIG. 6A an enlarged view of part of a blank 210 for forming an outer sleeve 290 is shown to illustrate the depressible zone 252 of the third embodiment. The depressible zone 252 differs from the depressible zone 52 of the first embodiment, in that the spaced side cuts 282, 284 are outwardly curved and the depressible zone 252 is convex in shape and in part is wider than the rectangular depressible zone 52 of the first embodiment. The depressible zone 252 is symmetrical about a notional central axis running parallel to a longitudinal axis of the outer top panel 220. Again two intermediate fold lines 286*b*, 286*c* are provided, but they are optionally each a different length since they extend across parts of the convexly shaped depressible zone 252 having different widths. Optionally, the two intermediate fold lines 286*b*, 286*c* terminate at the curved side edges 282, 284. The intermediate fold lines 286*b*, 286*c* are located closer to the rear most outer fold line 286*a*, than they are to the front most outer fold line 286*d*.

Figure 7A:
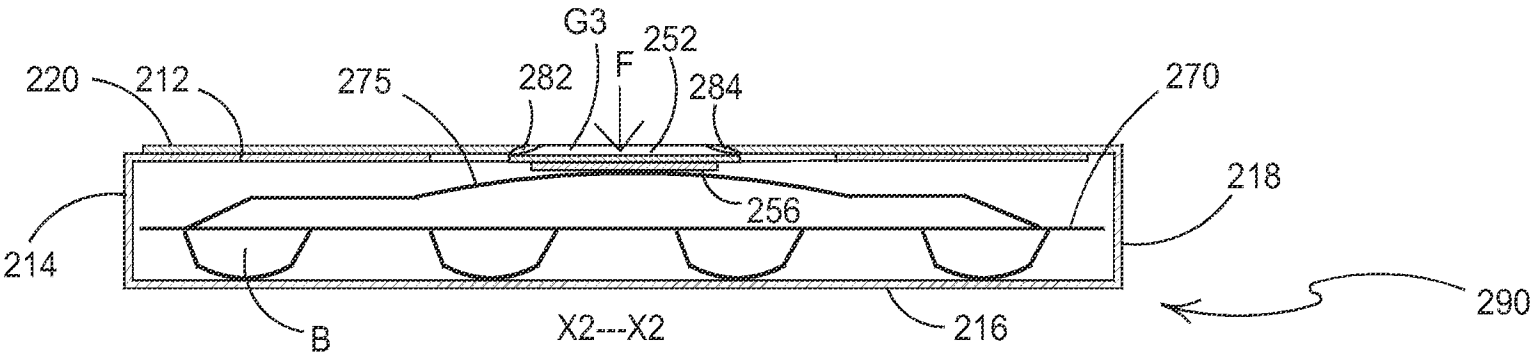
FIG. 7A is a cross-sectional view taken along the line X2-X2 shown in FIG. 6B, laterally across the deployed release mechanism of the third embodiment, illustrating how the release mechanism interacts with the lockable receptacle of FIG. 2C to release the lockable receptacle from its locking engagement with the outer sleeve of FIG. 6B.
Figure 7B:
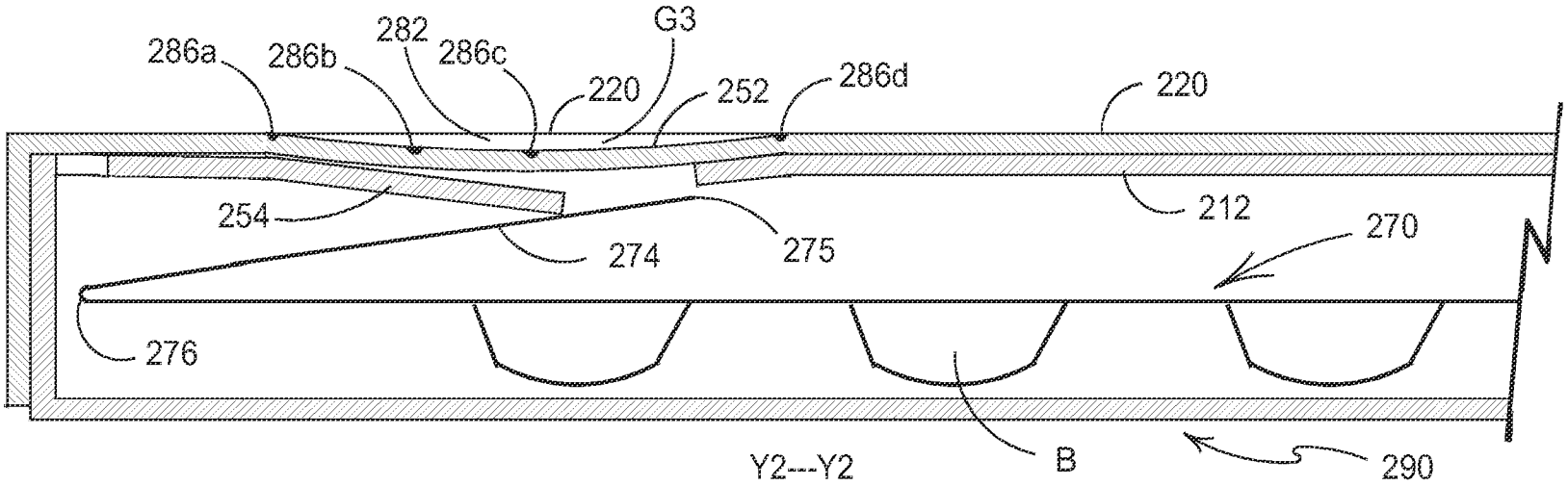
FIG. 7B is an enlarged view of part of a cross-sectional view taken along the line Y2-Y2 shown in FIG. 6B, longitudinally through the deployed release mechanism of the third embodiment, illustrating how the release mechanism interacts with the lockable receptacle of FIG. 2C to release the lockable receptacle from its locking engagement with the outer sleeve of FIG. 6B.

As with the first and second embodiments, when a downward force is applied in the vicinity of the intermediate fold lines 286*b*, 286*c*, the depressible zone 252 bows below the plane of the remainder of the outer top panel 220. This is illustrated by the opening of the gap G3 shown in FIG. 6B. The depressible zone 252 is depressed such that its lowest bent part is sufficiently bowed below the plane of the outer top panel 220 to contact the inner moveable tab 256, which in turn displaces the locking foot 274 of the lockable receptacle 270 to facilitate its release. As before, to ensure that the depressible zone 252 bends and bows in a predetermined manner, the applied release force, is preferably located in the vicinity of the intermediate fold lines 286*b*, 286*c* as shown in FIGS. 7A and 7B.

While the present invention has been described in terms of specific embodiments thereof, it will be understood that no limitations are intended thereby to the details of construction or design, the present invention contemplating and including any novel feature or novel combination of features which are herein disclosed.

It can be appreciated that various changes may be made within the scope of the present invention, for example, the size, number, configuration, position and relative placement, shape and physical formation of the or each panel, the locking structure and the moveable tabs of the release mechanism may be adjusted to suit the locking mechanism and/or size and/or colour and/or design and/or intended purpose of the package.

In other embodiments, it is envisaged that the side edges 82, 84 may each be formed from a frangible line. For example, a cut line including one or more connecting nick portions or other suitable temporary tether. In this way until the depressible zone is first used and the frangible side edges broken, the depressible zone remains connected on all sides to the outer top panel (or other panel of the outer sleeve from which it is formed).

In other envisaged embodiments, the outer sleeve is not formed from a blank of foldable sheet material but may be a molded construct, optionally having one or more pieces and further optionally formed from plastics material.

In other envisaged embodiments, the outer fold lines and intermediate fold lines terminate short of the side edges and as such do not fully extend across the depressible zone, albeit preferably, the outer fold lines and intermediate fold lines extend sufficiently across the depressible zone to pre-determine the manner in which the depressible zone deforms under force so that it can repeatedly and consistently bend in a manner that enables it to operate as a release mechanism.

In other envisaged embodiments, one or more or all of the moveable tabs included in the release mechanism may be affixed to a main part of the blank or outer sleeve rather than formed integrally therein.

In other envisaged embodiments the depressible zone is oriented at a non-normal angle. In other words a central axis, which may be a line of symmetry through the depressible zone is oriented at a non-normal angle. The non-normal angle may be considered relative to a rear end edge (for example 44) of an outer top panel. Optionally, the non-normal angle is about 45°. In other envisaged embodiments the non-normal angle $\alpha$ may be between about 20° and about 75°. Preferably, but nevertheless optionally, the non-normal angle $\alpha$ is between about 38° and about 52°. Having a non-normal angle of between about 42° and 47° relative to a rear end edge (for example 44) may offer an optimum orientation and position for the depressible zone 52 of the release mechanism 50. In such an arrangement, when the package is in use and is held by a user, with a substantially straight rear end wall (for example 34/36) in the palm of their hand, the angled depressible zone is presented substantially in line with a user's thumb. A user can then depress the depressible zone, holding the package more comfortably and can thereby gain access to a lockable receptacle 70 disposed comfortably and/or easily due to the orientation of the non-normally angled depressible zone. A non-normally angled depressible zone, arranged at about 45° may be more ergonomic and may require no or less twisting of a user's wrist to activate the release mechanism by depressing the depressible zone.

Optionally, it is additionally envisaged that the depressible zone may be used in conjunction with more than one inner moveable tab and/or inconjunction with an a demarcated pressing region provided in an outermost exterior panel of the package and that the depressible zone may be occluded from view in normal use and may not be readily visible. In such an embodiment, when a user depresses the package in a demarcated outer pressing region of the outermost panel that is in registry with the underlying depressible zone defined by side cuts and transverse fold lines, the depressible zone whilst hidden, is nevertheless caused to be depressed sufficiently to cause the unlocking of the two-part locking mechanism. The child resistance of the package may be further improved.

In embodiments including a demarcated outer pressing region, the or each pressing region may be a demarcated pressing region and may include any one or more of: an embossment, debossment, crease, groove, compressed region of material, integrally formed raised button or recess. Optionally the demarcated region may be formed by any one or more or an appropriate combination of: thermo-forming, molded, blow-molded, pressed, grooved, engraved, scored, and hatched.

It will be recognised that as used herein, directional references such as "top", "bottom", "front", "back", "end", "side", "inner", "outer", "upper" and "lower" do not necessarily limit the respective panels to such orientation, but merely serve to distinguish these panels from one another. Any reference to hinged connection should not be construed as necessarily referring to a single fold line only; indeed it is envisaged that hinged connection can be formed from one or more of the following, a short slit, a frangible line or a fold line without departing from the scope of the invention.

The phrase "in registry with" as used herein refers to alignment of two or more elements in an erected package, such as a moveable tab formed in an outer top panel and a moveable tab formed in an inner top panel. Those elements in registry with each other may be aligned with each other in the direction of the thickness of the overlapping panels.

The invention claimed is:

1. A package comprising a two-part locking mechanism and a release mechanism for deactivating the two-part locking mechanism, the release mechanism comprising a depressible zone, the depressible zone being at least substantially planar and formed in a panel of the package and being defined by two discrete, oppositely positioned and spaced cut or frangible side edges and the depressible zone otherwise being continuously formed with said panel, the depressible zone being structured and arranged such that the depressible zone is deformable below the plane of said panel to cause the two-part locking mechanism to be unlocked, wherein the depressible zone is structured and arranged such that the depressible zone is deformable below the plane of the said panel by the provision of one or more intermediate fold lines extending between and terminating on each of the two oppositely positioned cut or frangible side edges, wherein the depressible zone is further defined by two outer fold lines, each outer fold line extending between and terminating on the side cuts of the depressible zone, wherein the one or more intermediate fold lines comprises two intermediate fold lines both formed closer to one of said outer fold lines than to the other of said outer fold lines.

2. A package according to claim 1 wherein said two oppositely positioned cut or frangible side edges are each straight such that the depressible zone is generally rectangular in shape.

3. A package according to claim 1 wherein said two oppositely positioned cut or frangible side edges are each curved such that the depressible zone is generally concave in shape.

4. A package according to claim 1 wherein said two oppositely positioned cut or frangible side edges are each curved such that the depressible zone is generally convex in shape.

5. A package according to claim 1 wherein each of said two oppositely positioned cut or frangible side edges comprises a tear stop at each of its ends.

6. A package according to claim 5 wherein each tear stop is a "J"-shaped termination.

7. A package according to claim 1 wherein the package comprises an outer sleeve and a lockable receptacle, the outer sleeve providing a cavity for the lockable receptacle, the two-part locking mechanism for locking the lockable receptacle within the cavity of the outer sleeve and wherein the release mechanism is operable such that the lockable receptacle can be at least partially withdrawn from the outer sleeve.

8. A package according to claim 7 wherein the depressible tab is symmetrical in shape about a notional central axis of the depressible tab.

9. A package according to claim 8 wherein the notional central axis extends between said two outer fold lines.

10. A package according to claim 9 wherein the notional central axis is parallel to a longitudinal axis of the outer sleeve or wherein the notional central axis is perpendicular to a longitudinal axis of the outer sleeve.

11. A package according to claim 9 wherein the notional central axis is disposed at a non-normal angle relative to a longitudinal axis or lateral axis of the outer sleeve.

12. A package according to claim 11 wherein the non-normal angle is between about 35° and about 55°.

13. A package according to claim 12 wherein the non-normal angle is about 45°.

14. A package according to claim 7 wherein the outer sleeve comprises a closed rear end and an open or openable front end through which the lockable receptacle is insertable and through which the lockable receptacle is withdrawable.

15. A package according to claim 7 wherein the panel is an outer top panel of the outer sleeve and wherein the outer sleeve additionally comprises a bottom panel spaced from said outer top panel by first and second adjoining side panels and wherein an inner top panel is provided, the inner top panel being affixed in face contacting relationship to the outer top panel and comprising the first part of the two-part locking mechanism and comprising a moveable tab which forms part of the release mechanism.

16. A package according to claim 15 wherein the first part of the two-part locking mechanism comprises a locking edge defined by an aperture in the inner top panel disposed beneath said outer top panel; wherein the lockable receptacle comprises a folded locking foot, a free edge of which is receivable within the aperture and catchable against said locking edge for locking the lockable receptacle within the outer sleeve and wherein the depressible zone and movable tab are positioned and arranged such that depression of the depressible zone causes the depressible zone to bow beneath the plane of the outer top panel and which causes the moveable tab to move and cause the folded locking tail foot to be disengaged from the locking edge.

17. A package according to claim 16 wherein said moveable tab comprises: an anchored portion attached to the inner top panel of the outer sleeve; a front edge defined by the aperture; a first side edge and a second side edge; wherein the first and second side edges of the moveable tab are cut or frangible edges; wherein the first and second side edges are parallel to one another; and wherein the moveable tab is substantially "U"-shaped.

18. A package according to claim 17 wherein an outer top panel of the outer sleeve comprises a demarcated pressing zone disposed in registry with the depressible zone to assist a user in correctly directing an applied force toward said moveable tab such that sufficient depression of the moveable tab occurs to cause the two-part locking mechanism to be unlocked.

19. An outer sleeve for use in the package according to claim 7.

20. A blank of foldable material structured and arranged for being assembled into the outer sleeve of claim 19, the blank comprising a series of panels for forming walls of the outer sleeve including a first top panel in which the depressible zone defined by two oppositely positioned and spaced cut or frangible side edges is integrally formed.

* * * * *